US008411025B2

(12) United States Patent
Hong et al.

(10) Patent No.: US 8,411,025 B2
(45) Date of Patent: Apr. 2, 2013

(54) LIGHTING APPARAUTS

(75) Inventors: Sungho Hong, Seoul (KR); Jae Hun Yoon, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 49 days.

(21) Appl. No.: 13/081,237

(22) Filed: Apr. 6, 2011

(65) Prior Publication Data

US 2011/0204796 A1 Aug. 25, 2011

(30) Foreign Application Priority Data

Apr. 10, 2010 (KR) ..... 10-2010-0033008
Apr. 10, 2010 (KR) ..... 10-2010-0033009

(51) Int. Cl.
*G09G 3/36* (2006.01)

(52) U.S. Cl. ..... 345/102; 345/204; 345/211; 345/78; 345/82

(58) Field of Classification Search ..... 345/102, 345/204, 211–214, 77, 78, 80, 82
See application file for complete search history.

(56) References Cited

U.S. PATENT DOCUMENTS

| | | | | |
|---|---|---|---|---|
| 5,384,519 | A | 1/1995 | Gotoh | |
| 6,448,955 | B1 * | 9/2002 | Evanicky et al. | 345/102 |
| 6,506,506 | B1 | 1/2003 | Tomiuchi et al. | |
| 2005/0248524 | A1 * | 11/2005 | Feng et al. | 345/102 |
| 2006/0007108 | A1 * | 1/2006 | Utsumi et al. | 345/102 |
| 2006/0022935 | A1 * | 2/2006 | Sakai et al. | 345/102 |
| 2007/0268236 | A1 * | 11/2007 | Morrow | 345/102 |

(Continued)

FOREIGN PATENT DOCUMENTS

| | | |
|---|---|---|
| EP | 1983503 | 10/2008 |
| JP | 07-006878 | 1/1995 |

(Continued)

OTHER PUBLICATIONS

European Search Report for EP 11161419, citing the above reference(s).

(Continued)

*Primary Examiner* — Tuyet Thi Vo
(74) *Attorney, Agent, or Firm* — Lowe Hauptman Ham & Berner, LLP

(57) ABSTRACT

Disclosed is a lighting device. The lighting device includes:

a light source unit;

a first optical exciter and a second optical exciter converting lights emitted from the light source unit into lights having different color temperatures from each other and different color coordinates from each other;

a third optical exciter emitting light having a color coordinate and a color temperature which are different from those of the light converted by the second optical exciters;

a sensor outputting a first component signal, a second component signal and a third component signal, each of which corresponds to light quantities of a first component, a second component and a third component, respectively, of the light output from the first optical exciter, the second optical exciter and the third optical exciter;

a controller controlling light quantity of the light source unit such that a color coordinate of the light emitted from the first optical exciter, a color coordinate of the light emitted from the second optical exciter, and a color coordinate of the light emitted from the third optical exciter are placed within an area formed by the color coordinates of the first optical exciter, the second optical exciter and the third optical exciter; and a power supplier supplying voltage changing the light quantity of the light source unit under the control of the controller.

20 Claims, 11 Drawing Sheets

U.S. PATENT DOCUMENTS

| | | | | |
|---|---|---|---|---|
| 2009/0021471 | A1* | 1/2009 | Park et al. | 345/102 |
| 2009/0189841 | A1* | 7/2009 | Chen et al. | 345/102 |
| 2010/0053064 | A1* | 3/2010 | Hamada | 345/102 |
| 2012/0075358 | A1* | 3/2012 | Shirai et al. | 345/690 |

FOREIGN PATENT DOCUMENTS

| | | |
|---|---|---|
| JP | 2006-040642 | 2/2006 |
| JP | 2006-100036 | 4/2006 |
| JP | 2006-269293 | 10/2006 |
| JP | 2008-123818 | 5/2008 |
| JP | 2009-238729 | 10/2009 |
| KR | 1020010062712 | 7/2001 |
| KR | 1020060034915 | 4/2006 |
| KR | 1020100027895 | 3/2010 |
| WO | 01/84227 | 11/2001 |
| WO | 2006/105649 | 10/2006 |
| WO | 2007/034367 | 3/2007 |
| WO | 2009-015327 | 1/2009 |
| WO | 2010/012999 | 2/2010 |

OTHER PUBLICATIONS

Korean Notice of Allowance for 10-2010-0033008 dated Oct. 31, 2011, citing the above reference(s).

European Examination Report dated Jun. 21, 2012, citing the above reference(s).

Japanese Office Action for 2011-085967 dated Dec. 25, 2012, citing the above reference(s).

* cited by examiner

LIGHTING APPARAUTS

BACKGROUND

1. Field

This embodiment relates to a lighting apparatus.

2. Description of the Related Art

Recently, more and more attention is paid to a lighting apparatus. The lighting apparatus should be disposed in a certain place and emit light for a long time. For this reason, the lighting apparatus is required by a user thereof to uniformly maintain for a long period of time its characteristic such as a visual sensation of light emitted therefrom. When the characteristic of the lighting apparatus is not uniformly maintained, a user may feel fatigue of his/her eyes or be affected in activities using the lighting apparatus.

In addition, when the lighting apparatus is manufactured, various domestic and international standards are taken into account. That is, the lighting apparatus is manufactured according to the various domestic and international standards. Though the lighting apparatus is manufactured according to the aforementioned various standards, light emitted from the lighting apparatus is required to be fit the standards when the lighting apparatus is operated for a long time after being disposed.

SUMMARY

One embodiment is a lighting apparatus. The lighting apparatus includes:

a light source unit;

a first optical exciter and a second optical exciter converting lights emitted from the light source unit into lights having different color temperatures from each other and different color coordinates from each other;

a third optical exciter emitting light having a color coordinate and a color temperature which are different from those of the light converted by the second optical exciters;

a sensor outputting a first component signal, a second component signal and a third component signal, each of which corresponds to light quantities of a first component, a second component and a third component, respectively, of the light output from the first optical exciter, the second optical exciter and the third optical exciter;

a controller controlling light quantity of the light source unit such that a color coordinate of the light emitted from the first optical exciter, a color coordinate of the light emitted from the second optical exciter, and a color coordinate of the light emitted from the third optical exciter are placed within an area formed by the color coordinates of the first optical exciter, the second optical exciter and the third optical exciter; and a power supplier supplying voltage changing the light quantity of the light source unit under the control of the controller.

Another embodiment is a lighting apparatus. The lighting apparatus includes:

a first light source unit and a second light source unit emitting lights having different color temperatures from each other and different color coordinates from each other;

a third light source unit emitting light having a color coordinate and a color temperature which are different from those of the second light source unit;

a sensor outputting a first component signal, a second component signal and a third component signal, each of which corresponds to light quantities of a first component, a second component and a third component, respectively, of the light output from the first light source unit, the second light source unit and the third light source unit;

a controller controlling light quantities of the first light source unit, the second light source unit and the third light source unit such that a color coordinate of the light emitted from the first light source unit, a color coordinate of the light emitted from the second light source unit, and a color coordinate of the light emitted from the third light source unit are placed within an area formed by the color coordinates of the first light source unit, the second light source unit and the third light source unit; and a power supplier supplying voltage changing the light quantities of the first light source unit, the second light source unit and the third light source unit under the control of the controller.

DETAILED DESCRIPTION

A thickness or size of each layer is magnified, omitted or schematically shown for the purpose of convenience and clearness of description. The size of each component does not necessarily mean its actual size.

It will be understood that when an element is referred to as being 'on' or "under" another element, it can be directly on/under the element, and one or more intervening elements may also be present. When an element is referred to as being 'on' or 'under', 'under the element' as well as 'on the element' can be included based on the element.

Hereinafter, an embodiment according to the present invention will be described with reference to the accompanying drawings.

Figure 1:
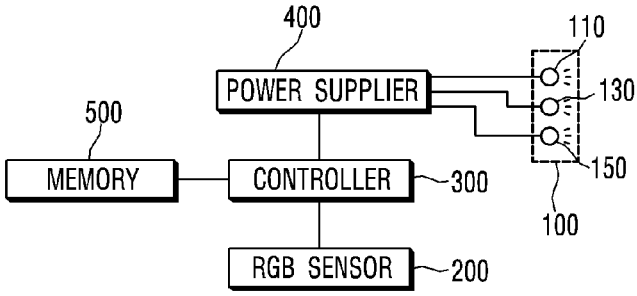
FIG. 1 shows a lighting apparatus according to a first embodiment of the present invention.

FIG. 1 shows a lighting apparatus according to a first embodiment of the present invention. As shown in FIG. 1, the lighting apparatus according to the first embodiment of the present invention includes a light source unit 100 including a first light source unit 110, a second light source unit 130 and at least one third light source unit 150, an RGB sensor 200, a controller 300 and a power supplier 400. The lighting apparatus shown in FIG. 1 includes one third light source unit 150 as well as the first light source unit 110 and the second light source unit 130. A lighting apparatus shown in FIG. 5 includes a plurality of third light source units 150*a* and 150*b* as well as the first light source unit 110 and the second light source unit 130.

The first light source unit 110 and the second light source unit 130 emit lights having different color temperatures from each other and different color coordinates from each other. That is, the first light source unit 110 emits light having a first color temperature and a first color coordinate. The second light source unit 130 emits light having a second color temperature and a second color coordinate. Since the embodiment of the present invention relates to a lighting apparatus, the first light source unit 110 and the second light source unit 130 are able to emit white light.

The at least one third light source unit 150 emits light having a color temperature and a color coordinate which are different from those of the first light source unit 110 and the second light source unit 130. The third light source unit 150 may include a light emitting diode (LED) capable of emitting light having a color temperature and a color coordinate which are different from those of the first light source unit 110 and the second light source unit 130.

The RGB sensor 200 outputs an R component signal, a G component signal and a B component signal, each of which corresponds to light quantities of an R (red) component, a G (green) component and a B (blue) component, respectively, of the light output from the first light source unit 110 to the third light source unit 150. That is, the RGB sensor 200 senses each of the light quantities of the R (red) component, G (green) component and B (blue) component of light mixed with lights emitted from a plurality of the light source units.

The RGB sensor 200 may include an R filter, a G filter and a B filter in order to detect the R (red) component, G (green) component and B (blue) component of light. The R filter, G filter and B filter transmit their corresponding components. That is, the R filter transmits the R (red) component. The G filter transmits the G (green) component. The B filter transmits the B (blue) component.

Here, the RGB sensor 200 may include an analog/digital converter (not shown) for converting an analog signal into a digital signal. When the analog/digital converter is included, a first light signal, a second light signal and a third light signal may be digital signals.

The controller 300 controls light quantities of the first light source unit 110, the second light source unit 130 and the third light source unit 150 such that a color coordinate of the light emitted from the first light source unit 110, a color coordinate of the light emitted from the second light source unit 130, and a color coordinate of the light emitted from the at least one third light source unit 150 are placed within an area formed by the color coordinates of the first light source unit 110, the second light source unit 130 and the at least one third light source unit 150. The operation of the controller 300 will be described later in detail.

The power supplier 400 supplies voltage changing the light quantities of the first light source unit 110, the second light source unit 130 and the third light source unit 150 under the control of the controller 300.

Here, the power supplier 400 is able to supply alternating current voltage having a controlled duty ratio to the first light source unit 110 to the third light source unit 150 under the control of the controller 300. To this end, the power supplier 400 may include a pulse width modulation (PWM) generator. The first light source unit 110, the second light source unit 130 and the third light source unit 150 may include LEDs. The light quantity of the LED is changeable depending on the duty ratio of the alternating current voltage.

Figure 2:
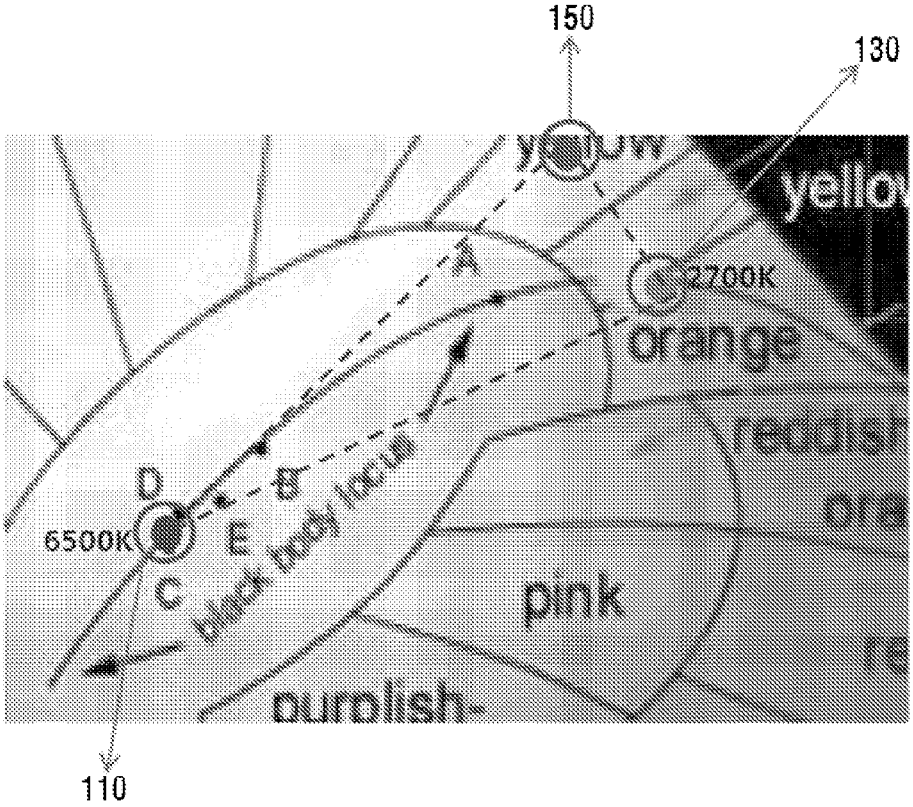
FIG. 2 shows a color coordinate system according to the first embodiment of the present invention.

FIG. 2 shows a color coordinate system according to the first embodiment of the present invention.

The lighting apparatus according to the embodiment of the present invention is able to increase an area capable of controlling a color coordinate. That is, unlike the embodiment of the present invention, when the lighting apparatus includes only the first light source unit 110 and the second light source unit 130, the color coordinate of the light of the lighting apparatus transforms along a straight line connecting the color coordinate of the first light source unit 110 and the color coordinate of the second light source unit 130.

On the contrary, the lighting apparatus according to the embodiment of the present invention includes, as shown in FIG. 2, the third light source unit 150 as well as the first light source unit 110 and the second light source unit 130. The RGB sensor 200 outputs the R component signal, G component signal and B component signal of the light output from the first light source unit 110 to the third light source unit 150.

The controller 300 calculates tristimulus values of X, Y and Z by using the R component signal, G component signal and B component signal. The tristimulus values of X, Y and Z may be calculated by using a kind of light illuminated to an object, a surface defined by reflectance, and a color matching function of the R component signal, G component signal and B component signal.

The controller 300 calculates a color coordinate of the light from the light source units by using the tristimulus values of X, Y and Z. An X component of the color coordinate is calculated by $X/(X+Y+Z)$. A Y component of the color coordinate is calculated by $Y/(X+Y+Z)$. A Z component of the color coordinate is calculated by $1-(X+Y)$.

In the embodiment of the present invention, the controller 300 sequentially calculates the tristimulus values and the color coordinate. However, when the R component signal, G component signal and B component signal are input, corresponding color coordinate value thereof may be stored in advance in the controller 300.

When the calculated color coordinate is out of an area formed by the color coordinates of the first light source unit 110, the second light source unit 130 and the third light source unit 150, the controller 300 controls the light quantities of the first, the second and the third light source units 110, 130 and 150 and causes the light of the lighting apparatus to be within the area.

As a result, the lighting apparatus according to the embodiment of the present invention is able to emit light having a color coordinate located within a triangular area formed by the color coordinate of the first light source unit 110, the color coordinate of the second light source unit 130 and the color coordinate of the third light source unit 150.

The lighting apparatus according to the embodiment of the present invention is able to control the light quantity in accordance with standard color coordinates located within an area formed by the color coordinate of the first light source unit 110, the color coordinate of the second light source unit 130 and the color coordinate of the third light source unit 150.

For this purpose, the lighting apparatus according to the embodiment of the present invention may further include a memory 500. The memory 500 stores the standard color coordinates.

The standard color coordinates of the memory 500 may correspond to a color coordinate for some points on the black body locus or to a color coordinate for some points approaching the black body locus.

In order to obtain the standard color coordinate by using the color coordinates of the lights emitted from the first light source unit 110, the second light source unit 130 and the third light source unit 150, the first light source unit 110, the second light source unit 130 and the third light source unit 150 may be controlled during the manufacturing process of the lighting apparatus such that the light quantities of the first light source unit 110, the second light source unit 130 and the third light source unit 150 change.

That is, during the manufacturing process of the lighting apparatus according to the embodiment of the present invention, light quantities of the R (red) component, G (green) component and B (blue) component of light emitted from the first light source unit 110, the second light source unit 130 and the third light source unit 150 are measured by a measuring device.

The tristimulus values of X, Y and Z are calculated by using the measured light quantities of the R (red) component, G (green) component and B (blue) component. Through the tristimulus values of X, Y and Z, a corresponding color coordinate can be calculated. When the corresponding color coordinate calculated through the tristimulus values of X, Y and Z are on the black body locus or approach the black body locus, the calculated color coordinate may be used as a standard color coordinate. The standard color coordinate obtained by the aforementioned method is stored in the memory 500. Here, the standard color coordinate, as described above, is located within the area formed by the color coordinates of the light source units.

Meanwhile, the controller 300 receives an R component signal, a G component signal and a B component signal from the RGB sensor 200 and generates a comparative color coordinate. Then, the controller 300 compares the comparative color coordinate with the standard color coordinate read from the memory 500 and generates a duty ratio control signal for reducing an error value between the standard color coordinate and the comparative color coordinate. Here, in order to generate the comparative color coordinate, the controller 300 calculates a corresponding tristimulus values by using the R component signal, G component signal and B component signal, and calculates the comparative color coordinate by using the tristimulus values.

Figure 3A:
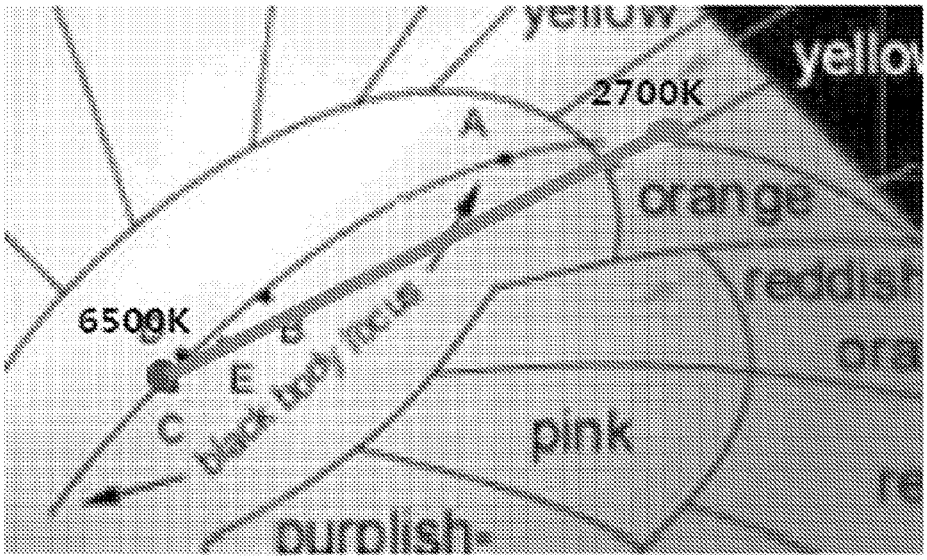
FIG. 3A shows transformations of a color temperature and a color coordinate when the lighting apparatus includes only a first light source unit and a second light source unit.

Unlike the embodiment of the present invention, when the lighting apparatus includes only the first light source unit 110 and the second light source unit 130, it is difficult for the lighting apparatus to emit light having a color temperature approaching the black body locus. For example, when the first light source unit 110 emits light having a color temperature of 6500K and the second light source unit 130 emits light having a color temperature of 2700K, the color temperature and color coordinate of the light, as shown in FIG. 3A, transform along a straight line in accordance with the light quantity changes of the first light source unit 110 and the second light source unit 130. As a result, there is a big difference between the transformation of the color temperature and color coordinate of the light and the transformation of the color temperature and color coordinate of the black body locus.

Figure 3B:
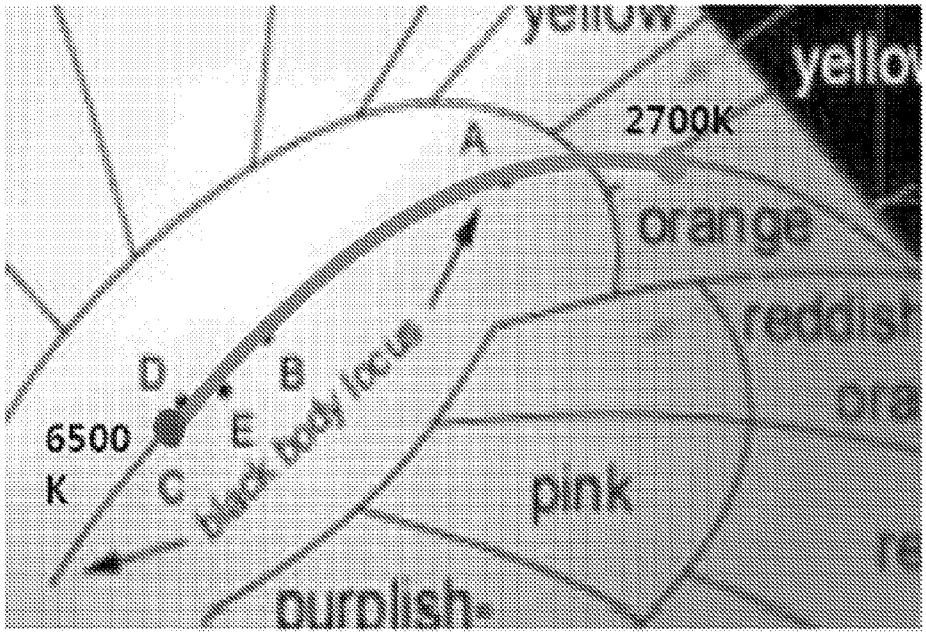
FIG. 3B shows transformation of a color temperature and a color coordinate of the lighting apparatus according to the embodiment of the present invention.

Meanwhile, as shown in FIG. 3B, when the lighting apparatus includes not only the first light source unit 110 and the second light source unit 130 but the third light source unit 150, the lighting apparatus is able to emit light having a color temperature and a color coordinate similar to those of the black body locus. For example, when the first light source unit 110 emits light having a color temperature of 6500K, the second light source unit 130 emits light having a color temperature of 2700K and the third light source unit 150 emits greenish white light, the lighting apparatus according to the embodiment of the present invention is able to emit light having a color temperature and a color coordinate, each of which transforms along the black body locus in accordance with the light quantity changes of the first light source unit 110 to the third light source unit 150.

In the foregoing description, the black body locus has been used as a standard for the color temperature of the lighting apparatus. However, it is possible to set a standard color coordinate of the lighting apparatus according to the embodiment of the present invention on the basis of MacAdam curve or Ansi bin curve which are other standards for the color temperature of a lighting apparatus.

Figure 4A:
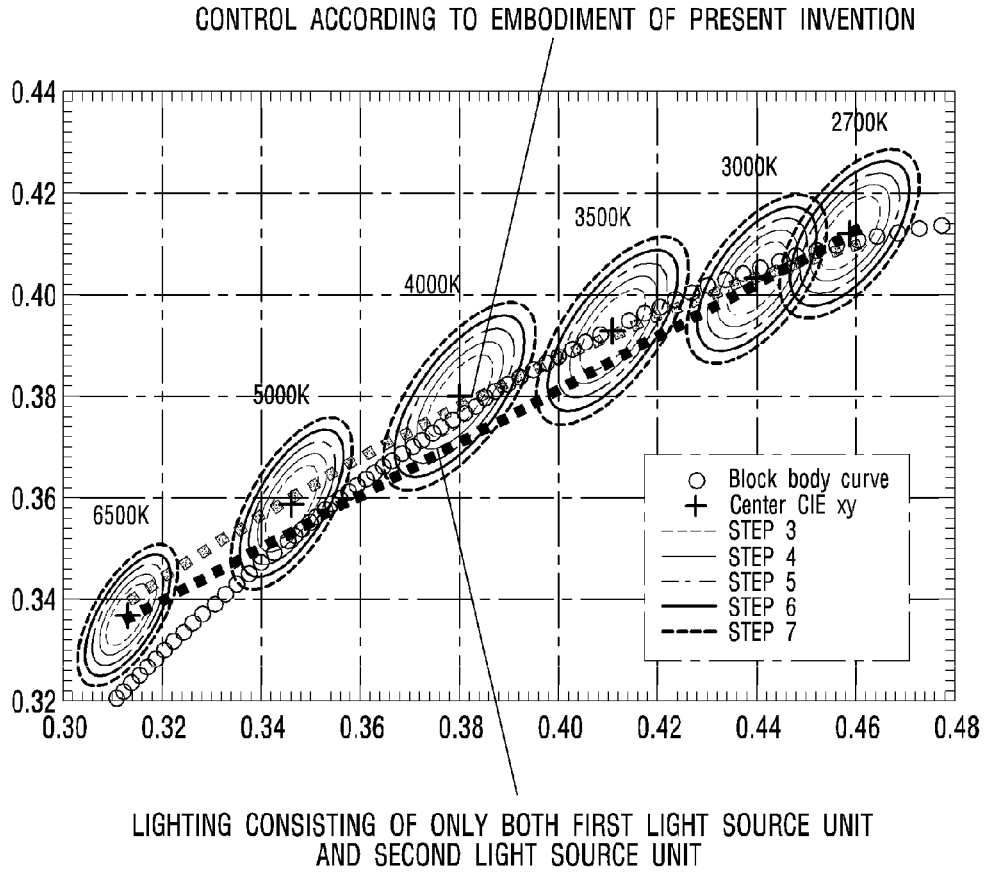
FIGS. 4A and 4B show a setting of a standard color coordinate in consideration of MacAdam curve and Ansi bin curve according to the first embodiment of the present invention and show the operation of the lighting apparatus.

The MacAdam curve shown in FIG. 4A shows a color distribution at the same color temperature.

Color distribution is greater at a specific color temperature toward an outer ellipse at the specific color temperature. As shown in FIG. 4A, unlike the embodiment of the present invention, when the lighting apparatus includes only the first light source unit 110 having a color temperature of 6500K and the second light source unit 130 having a color temperature of 2700K, the color distributions are increased at the color temperatures of 5000K, 4000K and 3500K of the light emitted from the lighting apparatus. Therefore, it can be seen that the characteristic of the lighting apparatus is deteriorated.

On the other hand, as described in the embodiment of the present invention, when a standard color coordinate is set such that the color distribution at each color temperature is within step 3, the light quantity changes of the first to the third light source units 110, 130 and 150 are controlled in accordance with the standard color coordinate, thereby improving the characteristic of the lighting apparatus. As a result, as regards each of the lights emitted from the light source units 110, 130 and 150 of the lighting apparatus according to the embodiment of the present invention, the color distribution at each color temperature may be within step 3.

Figure 4B:
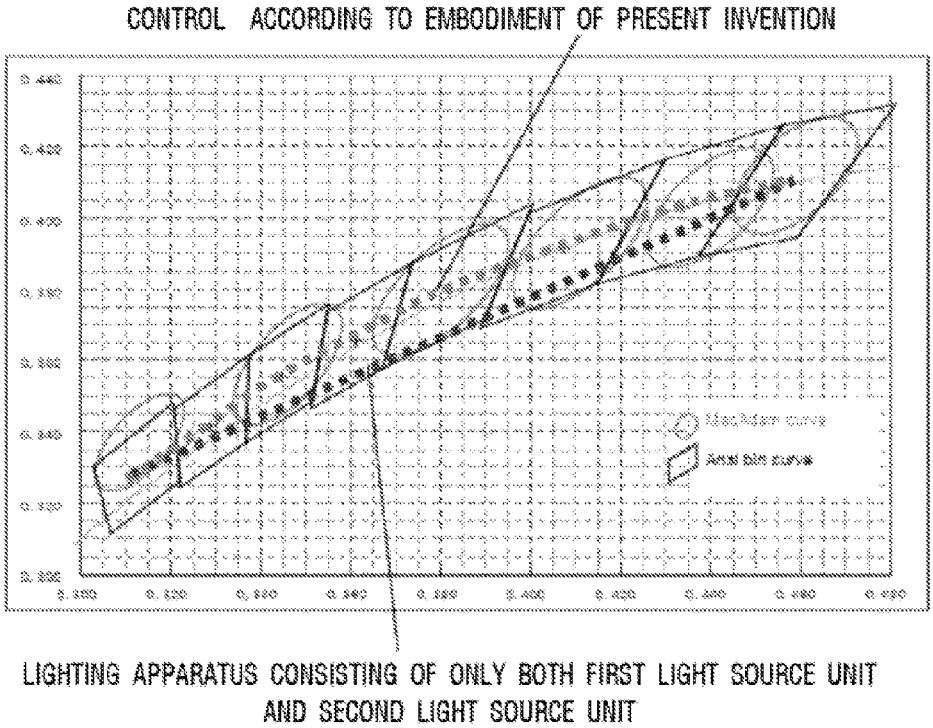

As shown in FIG. 4B, unlike the embodiment of the present invention, when the lighting apparatus includes only the first light source unit 110 having a color temperature of 6500 k and the second light source unit 130 having a color temperature of 2700 k, the color temperature transformation of light emitted by the lighting apparatus may not be located at the center of the Ansi bin curve.

On the contrary, in the embodiment of the present invention, a standard color coordinate can be set such that the color temperature transformation of light emitted by the lighting apparatus is close to the center of the Ansi bin curve. The light quantity changes of the first to the third light source units 110, 130 and 150 are controlled in accordance with the standard color coordinate, thereby improving the characteristic of the lighting apparatus.

The lighting apparatus according to the embodiment of the present invention may include four or more light source units.

Figure 5:
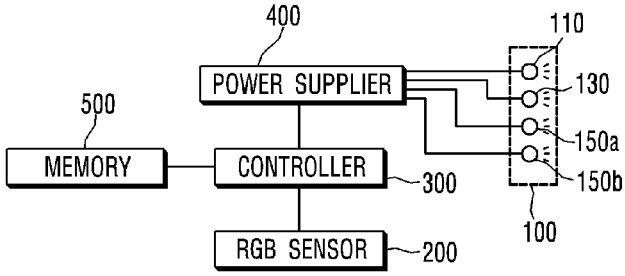
FIG. 5 shows a lighting apparatus according to a second embodiment of the present invention.

FIG. 5 shows a lighting apparatus according to a second embodiment of the present invention.

While the lighting apparatus of FIG. 5 includes four light source units, the lighting apparatus is allowed to include four or more light source units.

The plurality of the third light source units 150*a* and 150*b* emit light having a color temperature and a color coordinate which are different from those of the first light source unit 110 and the second light source unit 130. The plurality of the third light source units 150*a* and 150*b* also emit lights having color temperatures different from each other and having color coordinates different from each other. In other words, the color coordinate and the color temperature of the light emitted from a third light source unit 150 are different from those of another third light source unit 150.

Figure 6:
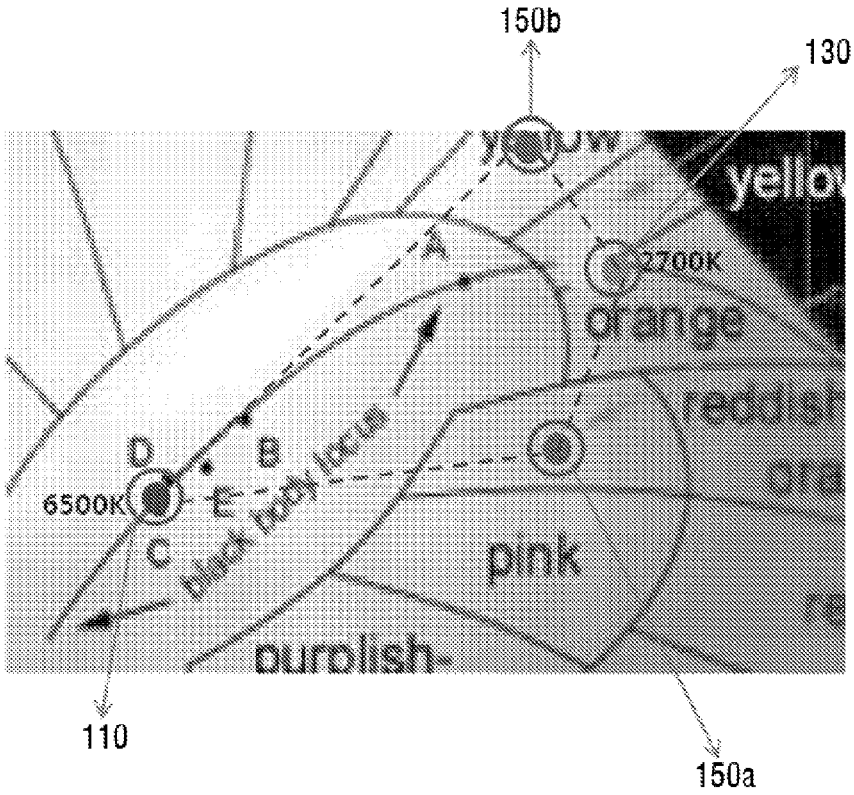
FIG. 6 shows a color coordinate system according to the second embodiment of the present invention.

Therefore, as shown in FIG. 6, light quantities of the light source units 110, 130, 150*a* and 150*b* may be controlled such that a color coordinate of the light from the lighting apparatus is placed within an area (a dotted-lined quadrangle) formed by the color coordinates of the first light source unit 110, the second light source unit 130 and the plurality of the third light source units 150*a* and 150*b*.

The standard color coordinates are located within the area (a dotted-lined quadrangle) formed by the color coordinates of the first, the second and a plurality of the third light source units 110, 130 and 150*a* and 150*b*. The controller 300 controls the light quantities of the first, the second and the third light source units 110, 130 and 150*a* and 150*b* such that an error between the standard color coordinates and the color coordinate of light actually emitted is reduced. Accordingly, as regards the lighting apparatus according to the embodiment of the present invention, an area capable of controlling the color coordinate may be increased.

Figure 7:
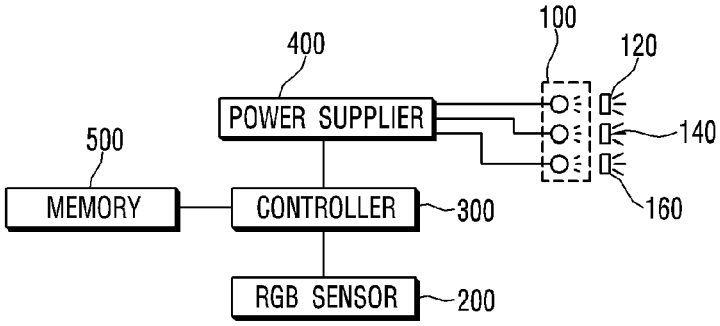
FIG. 7 shows a lighting apparatus according to a third embodiment of the present invention.

FIG. 7 shows a lighting apparatus according to a third embodiment of the present invention.

FIG. 7 shows, unlike FIG. 1, that optical exciters 120, 140 and 160 having mutually different wavelengths are added to the one or more light source units 100 having the same color temperature, so that an area in which the color coordinate can be controlled.

As shown in FIG. 7, the lighting apparatus according to an embodiment of the present invention includes a light source unit 100, a first optical exciter 120, a second optical exciter 140, at least one third optical exciter 160, an RGB sensor 200, a controller 300 and a power supplier 400.

The lighting apparatus shown in FIG. 7 includes one third optical exciter 160 as well as the first optical exciter 120 and the second optical exciter 140. A lighting apparatus shown in FIG. 10 includes a plurality of third optical exciters 160*a* and 160*b* as well as the first optical exciter 120 and the second optical exciter 140.

The light source unit 100 may include a plurality of light emitting diodes (LEDs). The LEDs of the of the light source unit 100 may emit lights having the same color temperature to each other. Therefore, the structure of the light source unit 100 may become simple.

The first optical exciter 120, the second optical exciter 140 and the third optical exciter 160 receive the light emitted from the light source unit 100 and emit lights having different wavelengths from each other.

To this end, the first optical exciter 120, the second optical exciter 140 and the third optical exciter 160 may include a luminescent film respectively. The luminescent film includes a resin layer and a fluorescent substance. The fluorescent substance is located between the resin layers. The light emitted from the light source unit 100 excites the fluorescent substance of the luminescent film. The fluorescent substance emits light having a specific wavelength.

Here, the first optical exciter 120 and the second optical exciter 140 emit lights having different color temperatures from each other and different color coordinates from each other. That is, the first optical exciter 120 emits light having a first color temperature and a first color coordinate. The second optical exciter 140 emits light having a second color temperature and a second color coordinate.

Since the embodiment of the present invention relates to a lighting apparatus, the first optical exciter 120 and the second optical exciter 140 can emit white light. Here the first optical exciter 120 may emit light having a color temperature of 6500 k and the second optical exciter 140 may emit light having a color temperature of 2700 k.

The third optical exciter 160 emits light having a color temperature and a color coordinate which are different from those of the first optical exciter 120 and the second optical exciter 140.

The RGB sensor 200 outputs an R component signal, a G component signal and a B component signal, each of which corresponds to light quantities of an R (red) component, a G (green) component and a B (blue) component, respectively, of the light output from the first optical exciter 120 to the third optical exciter 160. That is, the RGB sensor 200 senses each of the light quantities of the R (red) component, G (green) component and B (blue) component of light mixed with lights emitted from a plurality of the optical exciters 120, 140 and 160.

The RGB sensor 200 may include an R filter, a G filter and a B filter in order to detect the R (red) component, G (green) component and B (blue) component of light. The R filter, G filter and B filter transmit their corresponding components. That is, the R filter transmits the R (red) component. The G filter transmits the G (green) component. The B filter transmits the B (blue) component.

Here, the RGB sensor 200 may include an analog/digital converter (not shown) for converting an analog signal into a digital signal. When the analog/digital converter is included, a first light signal, a second light signal and a third light signal may be digital signals.

The controller 300 controls light quantities of the light source unit 100 such that a color coordinate of the light emitted from the first optical exciter 120, a color coordinate of the light emitted from the second optical exciter 140, and a color coordinate of the light emitted from the at least one third optical exciter 160 are placed within an area formed by the color coordinates of the first optical exciter 120, the second optical exciter 140 and the at least one third optical exciter 160. The operation of the controller 300 will be described later in detail.

The power supplier 400 supplies voltage changing the light quantities of the light source unit 100 under the control of the controller 300.

Here, the power supplier 400 can supply alternating current voltage having a controlled duty ratio to the light source unit 100 under the control of the controller 300. To this end, the power supplier 400 may include a pulse width modulation (PWM) generator. When the light source unit 100 includes light emitting diodes, the light quantity of the light emitting diode is changeable depending on the duty ratio of the alternating current voltage.

Figure 8:
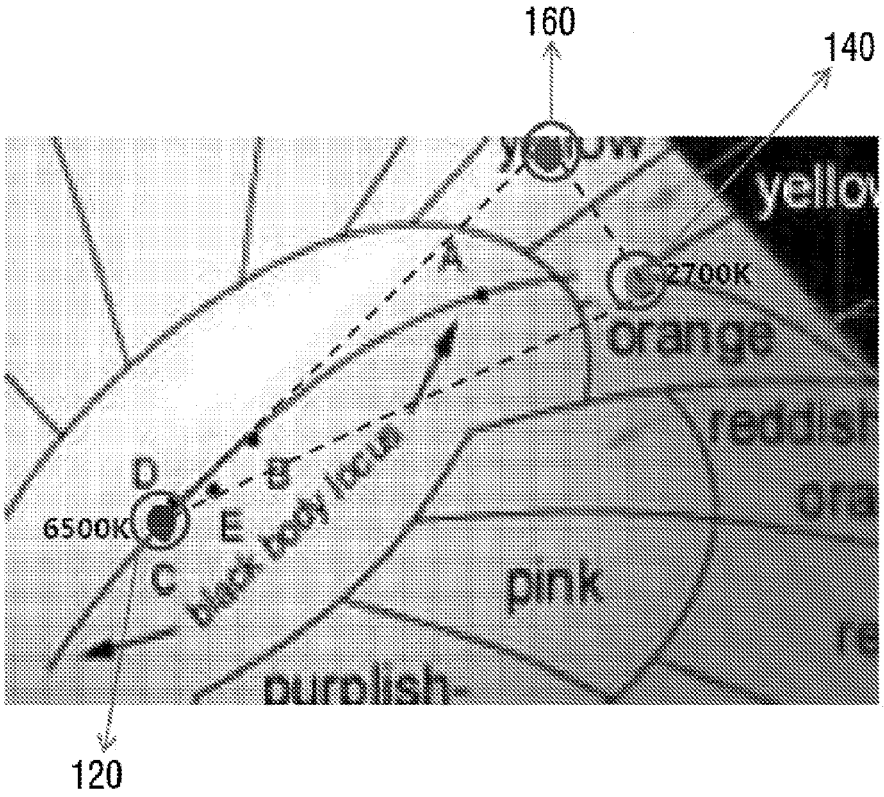
FIG. 8 shows a color coordinate system according to the third second embodiment of the present invention.

FIG. 8 shows a color coordinate system according to the third second embodiment of the present invention.

The lighting apparatus according to the embodiment of the present invention can increase an area capable of controlling a color coordinate. That is, unlike the embodiment of the present invention, when the lighting apparatus includes only the first optical exciter 120 and the second optical exciter 140, the color coordinate of the light of the lighting apparatus transforms along a straight line connecting the color coordinate of the light emitted from the first optical exciter 120 and the color coordinate of the light emitted from the second optical exciter 140.

On the contrary, the lighting apparatus according to the embodiment of the present invention includes the third optical exciter 160 as well as the first optical exciter 120 and the second optical exciter 140. The RGB sensor 200 outputs the R component signal, G component signal and B component signal of the light output from the first optical exciter 120 to the third optical exciter 160.

The controller 300 calculates tristimulus values of X, Y and Z by using the R component signal, G component signal and B component signal. The tristimulus values of X, Y and Z may be calculated by using a kind of light illuminated to an object, a surface defined by reflectance, and a color matching function of the R component signal, G component signal and B component signal.

The controller 300 calculates a color coordinate of the light from the optical exciters 120, 140 and 160 by using the tristimulus values of X, Y and Z. An X component of the color coordinate is calculated by X/(X+Y+Z). A Y component of the color coordinate is calculated by Y/(X+Y+Z). A Z component of the color coordinate is calculated by 1−(X+Y).

In the embodiment of the present invention, the controller 300 sequentially calculates the tristimulus values and the color coordinate. However, when the R component signal, G component signal and B component signal are input, corresponding color coordinate value thereof may be stored in advance in the controller 300.

When the calculated color coordinate is out of an area formed by the color coordinates of the lights emitted from the first optical exciter 120, the second optical exciter 140 and the at least one third optical exciter 160, the controller 300 controls the light quantities of the light source unit 100 and causes the light of the lighting apparatus to be within the area. Here, the light of the lighting apparatus is light mixed with lights emitted from a plurality of the optical exciters 120, 140 and 160.

As a result, the lighting apparatus according to the embodiment of the present invention is able to emit light having a color coordinate located within a triangular area formed by the color coordinate of the light emitted from the first optical exciter 120, the color coordinate of the light emitted from the second optical exciter 140 and the color coordinate of the light emitted from the third optical exciter 160.

The lighting apparatus according to the embodiment of the present invention is able to control the light quantity of the light source unit in accordance with standard color coordinates located within an area formed by the color coordinate of the light emitted the first optical exciter 120, the color coordinate of the light emitted from the second optical exciter 140 and the color coordinate of the light emitted from the third optical exciter 160.

For this purpose, the lighting apparatus according to the embodiment of the present invention may further include a memory 500. The memory 500 stores the standard color coordinates.

In order to obtain the standard color coordinate by using the color coordinates of the lights emitted from the first optical exciter 120, the second optical exciter 140 and the third optical exciter 160, the light source unit 100 is controlled during the manufacturing process of the lighting apparatus such that the light quantity of the light source unit 100 changes.

During the manufacturing process of the lighting apparatus according to the embodiment of the present invention, light quantities of the R (red) component, G (green) component and B (blue) component of light, which is emitted from the first optical exciter 120, the second optical exciter 140 and the third optical exciter 160 in accordance with the light quantity change of the light source unit 100, are measured by a measuring device.

Unlike the embodiment of the present invention, when the lighting apparatus includes only the first optical exciter 120 and the second optical exciter 140, it is difficult for the lighting apparatus to emit light having a color temperature approaching the black body locus. For example, when the first optical exciter 120 emits light having a color temperature of 6500K and the second optical exciter 140 emits light having a color temperature of 2700K, the color temperature and color coordinate of the light transform along a straight line in accordance with the light quantity changes of the lights emitted from the first optical exciter 120 and the second optical exciter 140. As a result, there is a big difference between the transformation of the color temperature and color coordinate of the light and the transformation of the color temperature and color coordinate of the black body locus.

Meanwhile, when the lighting apparatus includes not only the first optical exciter 120 and the second optical exciter 140 but the third optical exciter 160, the lighting apparatus is able to emit light having a color temperature and a color coordinate similar to those of the black body locus. For example, when the first optical exciter 120 emits light having a color temperature of 6500K, the second optical exciter 140 emits light having a color temperature of 2700K and the third optical exciter 160 emits greenish white light, the lighting apparatus according to the embodiment of the present invention is able to emit light having a color temperature and a color coordinate, each of which transforms along the black body locus in accordance with the light quantity changes of the first optical exciter 120 to the third optical exciter 160.

In the foregoing description, the black body locus has been used as a standard for the color temperature of the lighting apparatus. However, it is possible to set a standard color coordinate of the lighting apparatus according to the embodiment of the present invention on the basis of MacAdam curve or Ansi bin curve which are other standards for the color temperature of a lighting apparatus.

Figure 9A:
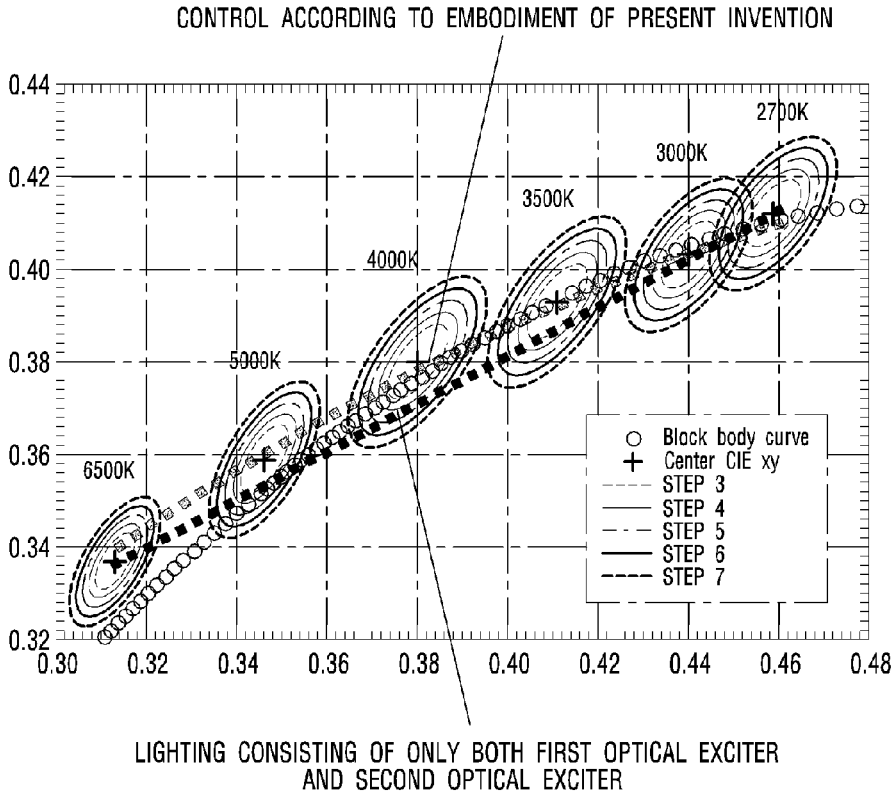
FIGS. 9A and 9B show a setting of a standard color coordinate in consideration of MacAdam curve and Ansi bin curve according to the third embodiment of the present invention and show the operation of the lighting apparatus.

The MacAdam curve shown in FIG. 9A shows a color distribution at the same color temperature.

Color distribution is greater at a specific color temperature toward an outer ellipse at the specific color temperature. As shown in FIG. 9A, unlike the embodiment of the present invention, when the lighting apparatus includes only the first optical exciter 120 having a color temperature of 6500K and the second optical exciter 140 having a color temperature of 2700K, the color distributions are increased at the color temperatures of 5000K, 4000K and 3500K of the light emitted from the lighting apparatus. Therefore, it can be seen that the characteristic of the lighting apparatus is deteriorated.

On the other hand, as described in the embodiment of the present invention, when a standard color coordinate is set such that the color distribution at each color temperature is within step 3, in accordance with the standard color coordinate, the light quantity of the light source units 100 is controlled, and the light quantities of the first to the third optical exciters 120, 140 and 160 are hereby changed, thereby improving the characteristic of the lighting apparatus. As a result, as regards each of the lights emitted from the optical exciters 120, 140 and 160 of the lighting apparatus according to the embodiment of the present invention, the color distribution at each color temperature may be within step 3.

Figure 9B:
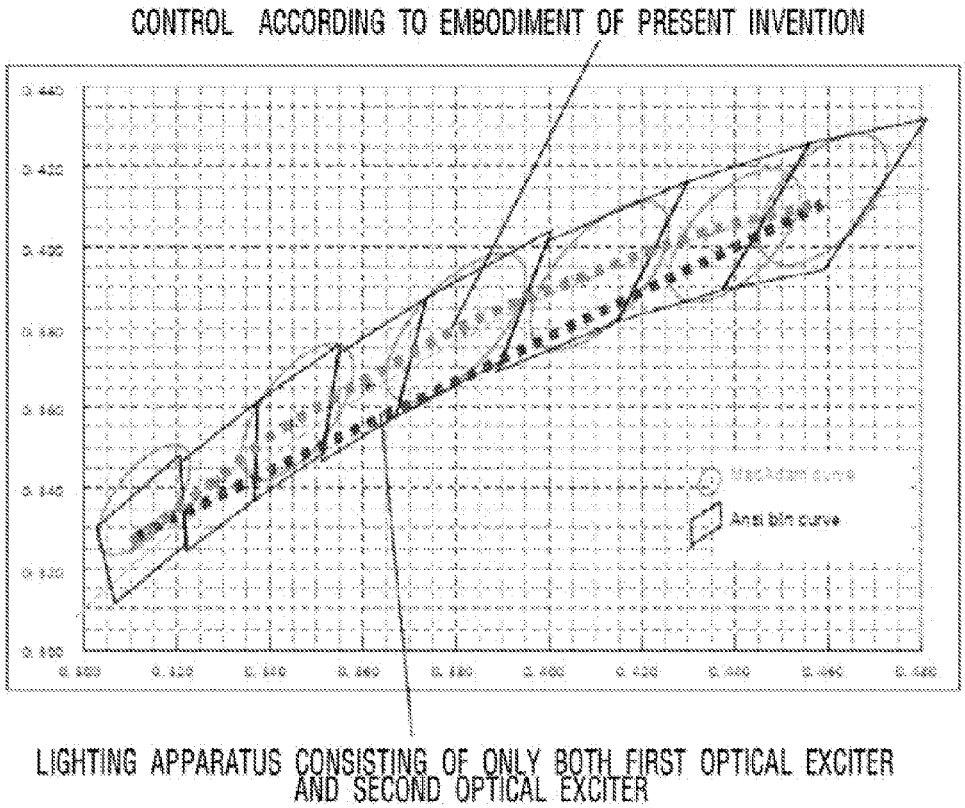

As shown in FIG. 9B, unlike the embodiment of the present invention, when the lighting apparatus includes only the first optical exciter 120 having a color temperature of 6500 k and the second optical exciter 140 having a color temperature of 2700 k, the color temperature transformation of light emitted by the lighting apparatus may not be located at the center of the Ansi bin curve.

On the contrary, in the embodiment of the present invention, a standard color coordinate can be set such that the color temperature transformation of light emitted by the lighting apparatus is close to the center of the Ansi bin curve. The light quantity of the light source unit 100 is controlled in accordance with the standard color coordinate. As a result, the light quantities of the first to the third optical exciters 120, 140 and 160 are changed, thereby improving the characteristic of the lighting apparatus.

The lighting apparatus according to the embodiment of the present invention may include four or more optical exciters.

Figure 10:
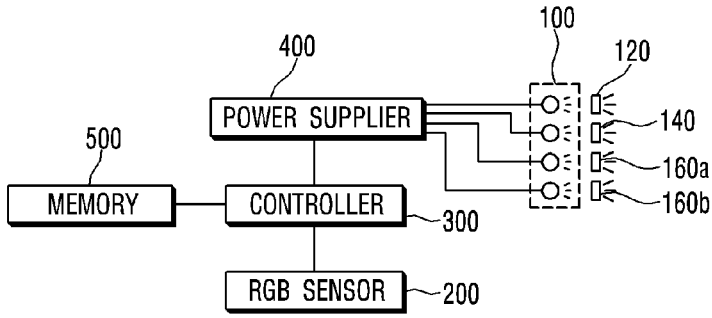
FIG. 10 shows a lighting apparatus according to a fourth embodiment of the present invention.

FIG. 10 shows a lighting apparatus according to a fourth embodiment of the present invention.

FIG. 10 shows, unlike FIG. 5, that optical exciters 120, 140, 160*a* and 160*b* having mutually different wavelengths are added to the one or more light source units 100 having the same color temperature, so that an area in which the color coordinate can be controlled.

While the lighting apparatus of FIG. 10 includes four optical exciters, the lighting apparatus is allowed to include four or more optical exciters.

The plurality of the third optical exciters 160*a* and 160*b* emit light having a color temperature and a color coordinate which are different from those of the first optical exciter 120 and the second optical exciter 140. The plurality of the third optical exciters 160*a* and 160*b* also emit lights having color temperatures different from each other and having color coordinates different from each other. In other words, the color coordinate and the color temperature of the light emitted from a third optical exciter 160*a* are different from those of another third optical exciter 160*b*.

Figure 11:
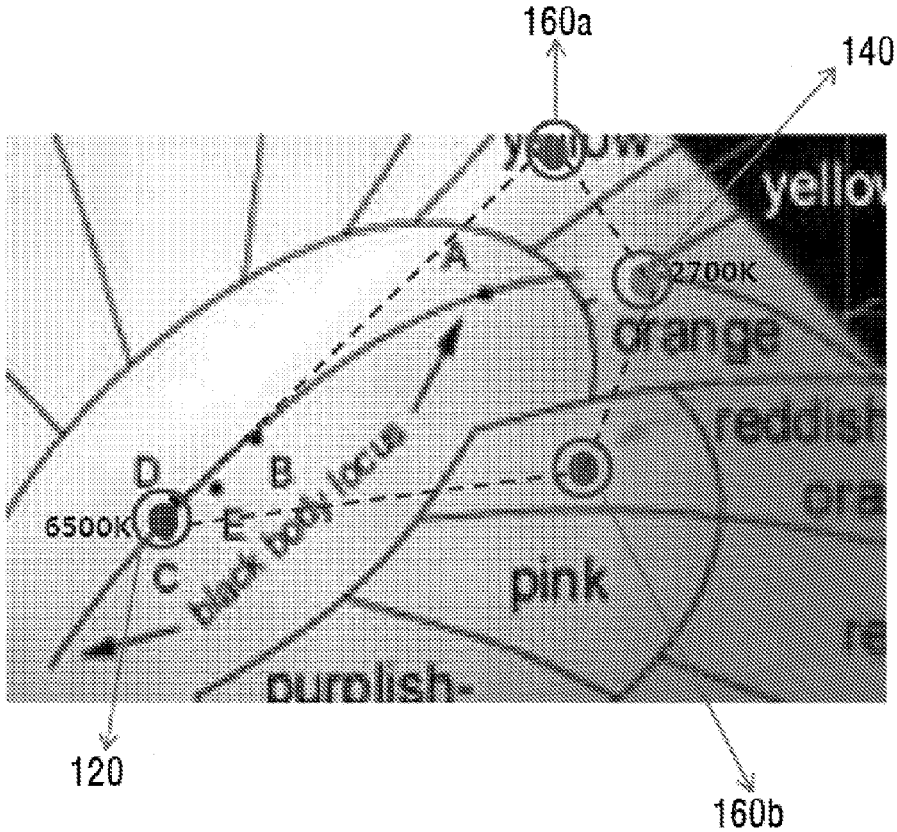
FIG. 11 shows a color coordinate system according to the fourth second embodiment of the present invention.

Accordingly, as shown in FIG. 11, the light quantity of the light source unit 100 is controlled such that a color coordinate of the light from the lighting apparatus is placed within an area (a dotted-lined quadrangle) formed by the color coordinates of the first optical exciter 120, the second optical exciter 140 and the plurality of the third light source units 160*a* and 160*b*.

The standard color coordinates are located within the area (a dotted-lined quadrangle) formed by the color coordinates of the first, the second and a plurality of the third optical exciters 120, 140 and 160*a* and 160*b*. The controller 300 controls the light quantity of the light source unit 100 such that an error between the standard color coordinates and the color coordinate of light actually emitted is reduced. Accordingly, since the light quantities of the first, the second and a plurality of the third optical exciters 120, 140 and 160*a* and 160*b* are changed, as regards the lighting apparatus according to the embodiment of the present invention, an area capable of controlling the color coordinate may be increased.

Figure 12A:
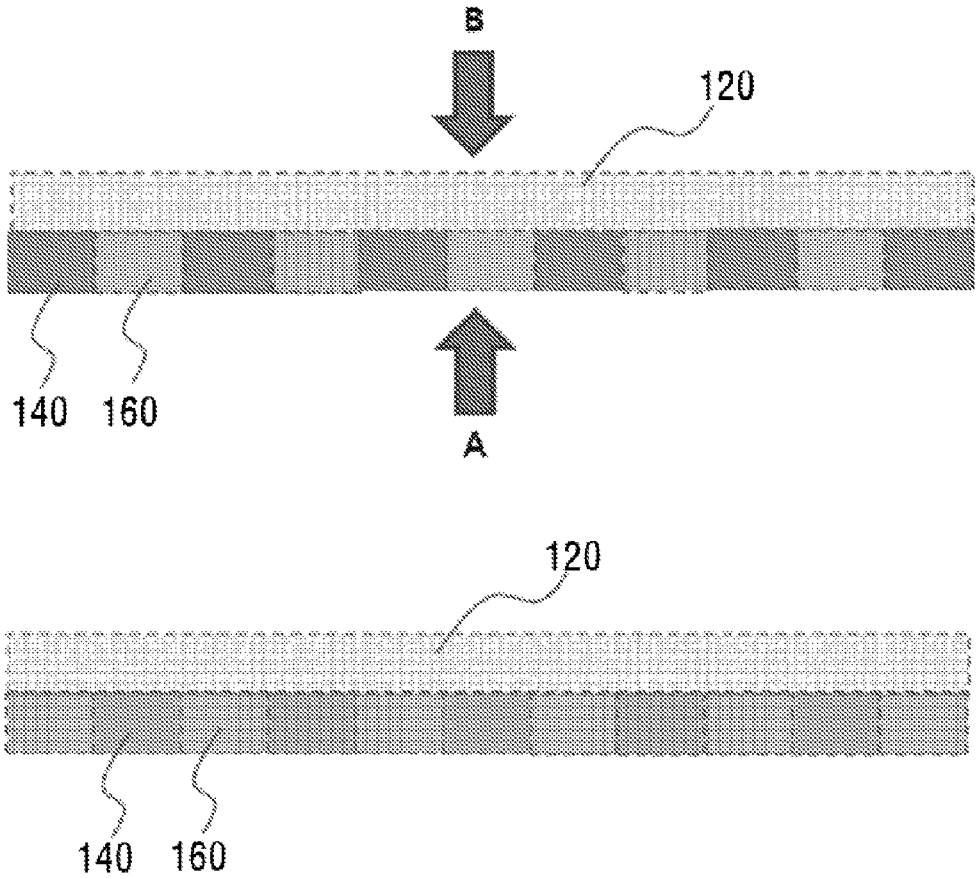
FIGS. 12A and 12B show how optical exciters of the lighting apparatus according to the embodiment of the present invention are arranged.

FIG. 12A shows how optical exciters of the lighting apparatus according to the embodiment of the present invention are arranged. As shown in the upper side of FIG. 12A, the second optical exciter 140 and the third optical exciter 160 are arranged adjacently to the first optical exciter 120. Here, the second optical exciter 140 and the third optical exciter 160 may be alternately arranged. The first optical exciter 120 is able to emit light having a color temperature of about 6500K.

As shown in the lower side of FIG. 12A, the third optical exciter and the second optical exciter 140 are arranged in the order listed adjacently to the first optical exciter 120. Here, the second optical exciter 140 and the third optical exciter 160 may be alternately arranged. The first optical exciter 120 is able to emit light having a color temperature of about 6500K. The second optical exciter 140 is able to emit light having a color temperature of about 2700K.

Figure 12B:
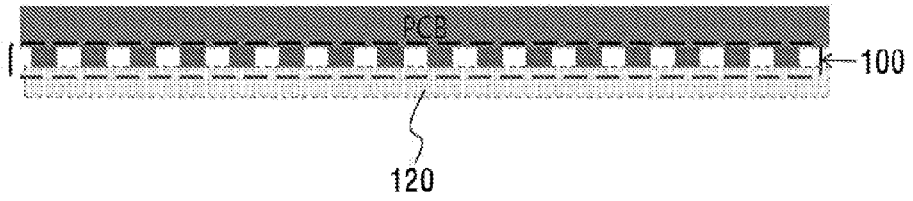
Figure 12B:
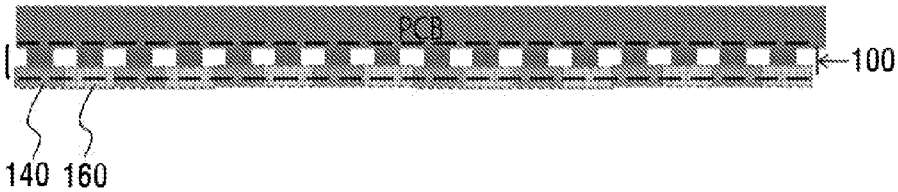

FIG. 12B shows that the optical exciters 120, 140 and 160 shown in the upper side of FIG. 12A are viewed from an "A" side and a "B" side. The figure on the upper side of FIG. 12B shows that the optical exciters are viewed from a "B" side. The figure on the lower side of FIG. 12B shows that the optical exciters are viewed from an "A" side.

As shown in FIG. 12B, the light source unit 100 includes a plurality of light emitting diodes (LEDs) mounted on a printed circuit board (PCB). A part of the LEDs may be located in an area of the first optical exciter 120. The rest of the LEDs may be located in areas of the second and the third optical exciters 140 and 160. The controller 300 is able to change the light quantity of each of the LEDs included in the light source unit 100 through a duty ratio control.

Figure 12C:
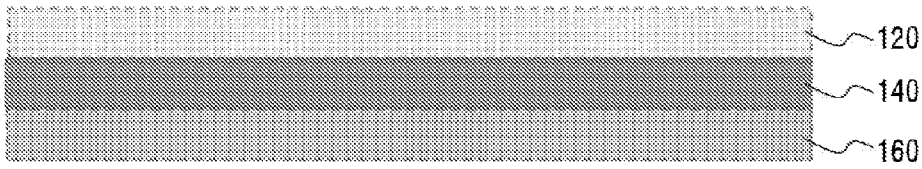
FIG. 12C shows that a second optical exciter and a third optical exciter of the lighting apparatus according to the embodiment of the present invention are arranged to face each other.

As described above, the second optical exciter 140 and the third optical exciter 160 may be alternately arranged and may be arranged adjacently to the first optical exciter 120. The areas which the second optical exciter 140 and the third optical exciter 160 occupy at the time when the second optical exciter 140 and the third optical exciter 160 are alternately arranged is as shown in FIG. 12C, smaller than the area which the second optical exciter 140 and the third optical exciter 160 occupy at the time when the second optical exciter 140 and the third optical exciter 160 are arranged facing each other. As a result, when the second optical exciter 140 and the third optical exciter 160 are alternately arranged, the volume of the lighting apparatus can be reduced.

While the embodiment of the present invention has been described with reference to the accompanying drawings, it can be understood by those skilled in the art that the present invention can be embodied in other specific forms without departing from its spirit or essential characteristics. Therefore, the foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A lighting apparatus comprising:

a light source unit which includes an LED (light emitting diode);

a first optical exciter and a second optical exciter converting lights emitted from the light source unit into lights having different color temperatures from each other and different color coordinates from each other;

a third optical exciter emitting light having a color coordinate and a color temperature which are different from those of the light converted by the second optical exciter;

a sensor outputting a first component signal, a second component signal, and a third component signal, wherein the first component signal corresponds to a light quantity of a first component of the light output from the first optical exciter, the second component signal corresponds to a light quantity of a second component of the light output from the second optical exciter, and the third component signal corresponds to a light quantity of a third component of the light output from the third optical exciter;

a controller controlling light quantity of the light source unit such that a color coordinate of the light emitted from the first optical exciter, a color coordinate of the light emitted from the second optical exciter, and a color coordinate of the light emitted from the third optical exciter are placed within an area formed by the color coordinates of the first optical exciter, the second optical exciter, and the third optical exciter;

a power supplier supplying voltage changing the light quantity of the light source unit under the control of the controller; and a memory having standard color coordinates located within an area formed by the color coordinates of the light output from the first optical exciter, the second optical exciter, and the third optical exciter, wherein the controller receives the first component signal, the second component signal, and the third component signal from the sensor, generates a comparative color coordinate, compares the comparative color coordinate with a standard color coordinate read from the memory, and controls light quantity of the light source unit in such a manner as to reduce an error value between the standard color coordinate and the comparative color coordinate.

2. The lighting apparatus of claim 1, wherein the light source unit includes LEDs having the same color temperature.

3. The lighting apparatus of claim 1, wherein the first optical exciter, the second optical exciter, and the third optical exciter each comprises a luminescent film, and wherein each luminescent film comprises a fluorescent substance located between resin layers.

4. The lighting apparatus of claim 1, wherein the sensor comprises a first filter, a second filter, and a third filter.

5. The lighting apparatus of claim 1, wherein the third optical exciter comprises a plurality of optical exciters, and wherein at least two third optical exciters emit lights having mutually different color temperatures and mutually different color coordinates.

6. The lighting apparatus of claim 1, wherein the first optical exciter and the second optical exciter emit white light.

7. The lighting apparatus of claim 1, wherein the power supplier supplies alternating current voltage having a controlled duty ratio under the control of the controller.

8. The lighting apparatus of claim 7, wherein the light source unit includes LEDs and wherein a light quantity of the LEDs changes depending on the duty ratio of the alternating current voltage.

9. The lighting apparatus of claim 1, wherein the second optical exciter and the third optical exciter are arranged adjacently to the first optical exciter, and wherein the second optical exciter and the third optical exciter are alternately arranged.

10. The lighting apparatus of claim 1, wherein the standard color coordinates are set according to a black body locus, MacAdam curve, and Ansi bin curve.

11. The lighting apparatus of claim 1, wherein light of the first component has red component, light of the second component has green component, and light of the third component has blue component.

12. A lighting apparatus comprising:

a first light source unit and a second light source unit each including an LED and emitting lights having different color temperatures from each other and different color coordinates from each other;

a third light source unit including an LED and emitting light having a color coordinate and a color temperature which are different from those of the second light source unit;

a sensor outputting a first component signal, a second component signal, and a third component signal, wherein the first component signal corresponds to a light quantity of a first component of the light output from the first light source unit, the second component signal corresponds to a light quantity of a second component of the light output from the second light source unit, and the third component signal corresponds to a light quantity of a third component of the light output from the third light source unit;

a controller controlling light quantities of the first light source unit, the second light source unit, and the third light source unit such that a color coordinate of the light emitted from the first light source unit, a color coordinate of the light emitted from the second light source unit, and a color coordinate of the light emitted from the third light source unit are placed within an area formed by the color coordinates of the first light source unit, the second light source unit, and the third light source unit;

a power supplier supplying voltage changing the light quantities of the first light source unit, the second light source unit, and the third light source unit under the control of the controller; and a memory having standard color coordinates located within an area formed by the color coordinates of the light output from the first light source unit, the second light source unit, and the third light source unit, wherein the controller receives the first component signal, the second component signal, and the third component signal from the sensor, generates a comparative color coordinate, compares the comparative color coordinate with a standard color coordinate read from the memory, and controls light quantities of the first light source unit, the second light source unit, and the third light source unit in such a manner as to reduce an error value between the standard color coordinate and the comparative color coordinate.

13. The lighting apparatus of claim 12, wherein the third light source unit comprises a plurality of light source units, and wherein at least two third light source units emit lights having mutually different color temperatures and mutually different color coordinates.

14. The lighting apparatus of claim 12, wherein the first light source unit and the second light source unit emit white light.

15. The lighting apparatus of claim 12, wherein the power supplier supplies alternating current voltage having a controlled duty ratio under the control of the controller.

16. The lighting apparatus of claim 15, wherein the first light source unit, the second light source unit, and the third light source unit include LEDs, and wherein a light quantity of the LEDs changes depending on the duty ratio of the alternating current voltage.

17. The lighting apparatus of claim 12, wherein the standard color coordinates are set according to a black body locus, MacAdam curve, and Ansi bin curve.

18. The lighting apparatus of claim 12, wherein color distribution at each color temperature of lights emitted from the first light source unit, the second light source unit, and the third light source unit is within step 3.

19. A lighting apparatus comprising:

a first light source unit, a second light source unit, and a third light source unit each including an LED which emit light having a color coordinate and a color temperature;

a sensor outputting a first component signal, a second component signal, and a third component signal, wherein the first component signal corresponds to a light quantity of the light output from the first light source unit, the second component signal corresponds to a light quantity of the light output from the second light source unit, and the third component signal corresponds to a light quantity of the light output from the third light source unit;

a controller controlling light quantities of the first light source unit, the second light source unit, and the third light source unit such that a first color coordinate of the light emitted from the first light source unit, a second color coordinate of the light emitted from the second light source unit, and a third color coordinate of the light emitted from the third light source unit are placed within an area formed by the color coordinates of the first light source unit, the second light source unit, and the third light source unit; and a memory having standard color coordinates located within an area formed by the color coordinates of the light output from the first light source unit, the second light source unit, and the third light source unit, wherein the controller receives the first component signal, the second component signal, and the third component signal from the sensor, generates a comparative color coordinate, compares the comparative color coordinate with the standard color coordinate read from the memory, and controls light quantities of the first light source unit, the second light source unit, and the third light source unit in such a manner as to reduce an error value between the standard color coordinate and the comparative color coordinate.

20. The lighting apparatus of claim 19, wherein the first light source unit and the second light source unit emit white light.

* * * * *